US006082454A

United States Patent [19]

Tubel

[11] Patent Number: 6,082,454

[45] Date of Patent: Jul. 4, 2000

[54] SPOOLED COILED TUBING STRINGS FOR USE IN WELLBORES

[75] Inventor: Paulo S. Tubel, The Woodlands, Tex.

[73] Assignee: Baker Hughes Incorporated, Houston, Tex.

[21] Appl. No.: 09/063,771

[22] Filed: Apr. 21, 1998

[51] Int. Cl.[7] ..... E21B 47/00

[52] U.S. Cl. ..... 166/250.15; 166/77.1; 166/77.2

[58] Field of Search ..... 166/250.07, 250.15, 166/250.17, 77.2, 77.3, 77.1

[56] References Cited

U.S. PATENT DOCUMENTS

| | | | |
|---|---|---|---|
| 1,656,215 | 1/1928 | McDonald et al. . | |
| 4,735,270 | 4/1988 | Fenyvesi | 175/113 |
| 4,938,060 | 7/1990 | Sizer et al. | 73/151 |
| 5,285,204 | 2/1994 | Sas-Jaworski . | |
| 5,350,018 | 9/1994 | Sorem et al. | 166/250 |
| 5,413,170 | 5/1995 | Moore . | |
| 5,485,754 | 1/1996 | Rademaker et al. | 73/151 |
| 5,494,105 | 2/1996 | Morris | 166/255.1 |
| 5,505,259 | 4/1996 | Wittrisch et al. | 166/250.01 |
| 5,517,593 | 5/1996 | Nenniger et al. | 166/60 X |
| 5,542,472 | 8/1996 | Pringle et al. . | |
| 5,765,643 | 6/1998 | Shaaban et al. | 166/384 |

FOREIGN PATENT DOCUMENTS

| | | | |
|---|---|---|---|
| 2283517 | 5/1995 | United Kingdom . | |
| 2 330 161 | 4/1999 | United Kingdom . | |
| WO97/42394 | 11/1997 | WIPO | E21B 19/22 |

OTHER PUBLICATIONS

"Coiled Tubing . . . operations and services"; Oil World, Nov. 1991, No. 11, Houston, Texas; pp. 41–47.

*Primary Examiner*—Frank S. Tsay
*Attorney, Agent, or Firm*—Madan, Mossman, & Sriram P.C.

[57] ABSTRACT

This invention provides oilfield spooled coiled tubing production and completion strings assembled at the surface to include sensors and one or more controlled devices which can be tested from a remote location. The devices may have upsets in the coiled tubing. The strings preferably include conductors and hydraulic lines in the coiled tubing. The conductors provide power and data communication between the sensors, devices and surface instrumentation. The coiled tubing strings are preferably tested at the assembly site and transported to the well site one reels. The coiled tubing strings are inserted and retrieved from the wellbores utilizing an adjustable opening injector head system.

18 Claims, 3 Drawing Sheets

SPOOLED COILED TUBING STRINGS FOR USE IN WELLBORES

BACKGROUND OF THE INVENTION

1. Field of the Invention

This invention relates generally to completion and production strings and more particularly to spooled coiled tubing strings having devices and sensors assembled in the string and tested at the surface prior to their deployment in the wellbores.

2. Background of the Art

To obtain hydrocarbons from the earth subsurface formations ("reservoirs") wellbores or boreholes are drilled into the reservoir. The wellbore is completed to flow the hydrocarbons from the reservoirs to the surface through the wellbore. To complete the wellbore, a casing is typically placed in the wellbore. The casing and the wellbore are perforated at desired depths to allow the hydrocarbons to flow from the reservoir to the wellbore. Devices such as sliding sleeves, packers, anchors, fluid flow control devices and a variety of sensors are installed in or on the tubing. Such wellbores are referred to as the "cased holes." For the purpose of this invention, the casing with the associated devices is referred to as the completion string. Additional tubings, flow control devices and sensors are sometimes installed in the casing to control the fluid flow to the surface. Such tubings along with the associated devices are referred to as the "production strings". An electric submersible pump (ESP) is installed in the wellbore to aid the lifting of the hydrocarbons to the surface when the downhole pressure is not sufficient to provide lift to the fluid. Alternatively, the well, at least partially, may be completed without the casing by installing the desired devices and sensors in the uncased well. Such completions are referred to as the "open hole" completions. A string may also be configured to perform the functions of both the completion string and the production string.

Coiled tubing is sometimes used as the tubing for the completion and/or production strings. The coiled tubing is transported to the well site on spools or reels and the devices that cause upsets in the tubing are integrated into the coiled tubing at the well site as it is deployed into the wellbore. Spooled coiled tubing strings with integrated or preamended devices have been proposed. Such strings can be assembled at the factory and deployed in the wellbore without additional assembly at the well site. However, the prior art proposed spooled coiled tubing strings require that there be no "upsets" of the outer diameter of the coiled tubing, i.e., the devices integrated into the coiled tubing must be placed inside the coiled tubing or that their outer surfaces be flush with the outer diameter of the coiled tubing. Such limitations have been considered necessary by the prior art because coiled tubings are inserted and retrieved from the wellbores by injector heads, which are typically designed to handle coiled tubings of uniform outer dimensions. In many oilfield applications, it is not feasible or practical to avoid upsets because the gap between the coiled tubing and the borehole wall or the casing may be too large for efficient use of certain devices such as packers and anchors or because of other design and safety considerations. Also, limiting the outer diameter of the devices to the coiled tubing diameter will require designing new devices.

Additionally, the prior art coiled tubing strings do not include sensors required for determining the operation and health (condition) of the various devices and sensors in the string, or controllers downhole and/or at the surface for operating the downhole devices, for monitoring production from the wellbore and for monitoring the wellbore and reservoir conditions during the life of the wellbore. The prior art spooled coiled tubing strings do not provide mechanisms for testing the devices and sensors from a remote end of the string at the surface before the deployment of such strings in the wellbores. Completely assembling the string with desired devices and sensors and having mechanisms to test the operations of the devices and the sensors at the factory prior to the deployment of the string in the wellbore can substantially increase the quality and reliability of the such strings and reduce the deployment or retrieval time.

The present invention provides spooled coiled tubing strings which include the desired devices and sensors and wherein the devices may cause upsets in the coiled tubing. The string is assembled and tested at the factory and transported to the well site on spools and deployed into the wellbore by a an injector head system designed to accommodate upsets in the tubing strings. The strings of the present invention may be completion strings, production strings and may be deployed in open or cased holes.

SUMMARY OF THE INVENTION

This invention provides oilfield coiled tubing production and completion strings (production and/or completion strings) which are assembled at the surface to include sensors and one or more controlled devices that can be tested from a remote end of the string. The devices may cause upsets in the coiled tubing. The strings preferably include data communication and power links and hydraulic lines along the coiled tubing. The conductors provide power and data communication between the sensors, devices and surface instrumentation. The coiled tubing strings are available for testing of the sensors and devices at the assembly site and are transported to the well site on reels. The coiled tubing strings are inserted and retrieved from the wellbores utilizing adjustable opening injector heads. Preferably two injector heads are used to accommodate for the upsets and to move the coiled tubing.

In one embodiment, the string includes at least one flow control device for regulating the flow of the production fluids from the well, a controller associated with the flow control device for controlling the operation of the flow control device and the flow of fluid therethrough, a first set of sensors monitoring downhole production parameters adjacent the flow control device, and a second set of sensors along the coiled tubing and spaced from the flow control device provides measurements relating to wellbore parameters. Some of these sensors may monitor formation parameters such as resistivity, water saturation etc. The sensors may include pressure sensors, temperature sensors, vibration sensors, accelerometers, sensors for determining the fluid constituents, sensors for monitoring operating conditions of downhole devices and formation evaluation sensors. The controller receives the information from the sensors and in response thereto and other parameters or instructions provides control signals to the control device. The controller is preferably located at least in part downhole. The sensors may be of any type including fiber optic sensors. The communication link may be a conventional bus or fiber optic link extending from the surface to the devices and sensors in the string. A hydraulic line run along the coiled tubing may be used to activate hydraulically-operated devices.

In an alternative embodiment, the coiled tubing string is a completion string that includes sensors and a controlled device and which is available for testing of the sensors and device on the string from the remote end of the string before deployment of the string in the wellbore. A flow control device on the coiled tubing regulates the produced fluids from the well. A controller associated with the flow control device controls the operation of the device and the flow of fluid therethrough. A first set of sensors monitors the downhole production parameters adjacent the flow control device. The surface-operated devices in the string are activated or set after the deployment of the string in the wellbore.

BRIEF DESCRIPTION OF THE DRAWINGS

For a detailed understanding of the present invention, reference should be made to the following detailed description of the preferred embodiment, taken in conjunction with the accompanying drawings, in which like elements have been given like numerals, wherein.

DETAILED DESCRIPTION OF PREFERRED EMBODIMENTS

Figure 1:
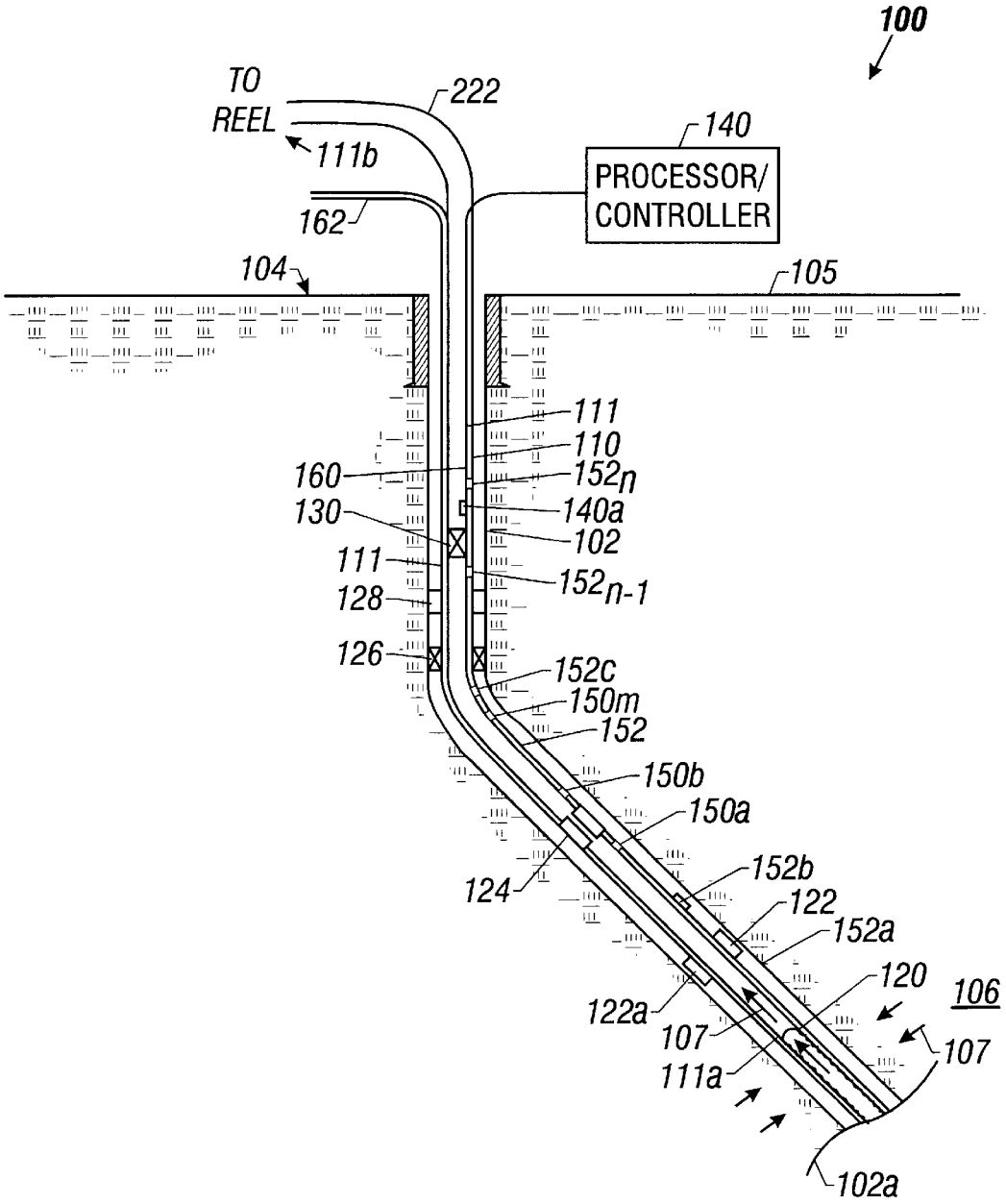
FIG. 1 is a schematic illustration of an exemplary coiled tubing string made according to the present invention deployed in a wellbore.

FIG. 1 is a schematic illustration of an exemplary coiled tubing completion string 110 made according to one embodiment of the present invention and deployed in an open hole 102. For simplicity and for ease of explanation, the term wellbore or borehole used herein refers to either the open hole or cased hole. The string 110 is assembled at the factory and transported to the well site 104 by conventional means. After the wellbore 102 has been drilled to a desired depth, the string 110 is inserted or deployed in the wellbore 102 by any suitable method. A preferred injector head system for the deployment and retrieval of the spooled coiled tubing strings of the present invention is described below with reference to FIG. 3. The various desired devices and sensors in the string 110 are placed or integrated into the string 110 at predetermined locations so that when the string 110 is deployed in the wellbore 102, the devices and sensors in the string 110 will be located at their desired depths in the wellbore 102.

In the example of FIG. 1, the string 110 includes a coiled tubing 111 having at its bottom end 111*a* a flow control device 120 that allows the formation fluid 107 from the production zone or reservoir 106 to flow into the tubing 111. The flow control device may be a screen, an instrumented screen, an electrically-operated and/or remotely controlled slotted sleeve or any other suitable device. An internal fluid flow control valve 124 in the coiled tubing 111 controls the fluid flow through the tubing 111 to the surface 105. One or more packers, such as packers 122 and 126, are installed at appropriate locations in the string 110. For the purposes of illustration, the packer 122 is shown in its initial or unextended position while the packer 126 is shown in its fully extended or deployed position in the wellbore 102. The packers 122 and 126 may be flush with the coiled tubing 111 or on the outside of the coiled tubing 111 that causes upsets in the tubing. An annular safety valve 128 is provided on the tubing 111 to prevent blow outs. Other desired devices, generally referred herein by numeral 130 may be located in the string 110 at desired locations. The packers 122 and 126, annular safety valve 128 and any of the devices 130 may cause upsets in the coiled tubing 111 as shown at 122*a* for the packer 122. The outer dimension 122*a* of the packer 122 is greater than the diameter of the coiled tubing 111. It should be noted that spooled strings of the present invention are not limited to the devices described herein. Any spoolable device or sensor may be utilized in such strings. Such other devices may include, without limitation, anchors, control valves, flow diverters, seal assemblies electrically submersible pumps (ESP) and any other spoolable device.

The devices 120, 122, 126 and 130 may be hydraulically-operated, electrically-operated, electrically-actuated and hydraulically operated, or mechanically operated. For example, as noted above, the flow restriction device 120 may be a remotely-controlled electrically-operated device wherein the fluid flow from the formation 107 to the wellbore 102 can be adjusted from the surface or by a downhole controller. The screen 120 may be instrumented to operate in any other manner. The packers 122 and 126 may be hydraulically-operated and may be set by the supply of fluid under pressure from the surface 105 or activated from the surface and set by the hydrostatic pressure of the wellbore 102. the devices 130 may also include solenoid-controlled devices to regulate or modulate the fluid flow through string 110.

Still referring to FIG. 1, sensors 150*a*–150*m* in the string 110 monitor the downhole production parameters adjacent the flow control device 124. These sensors include flow rate sensors or flow meters, pressure sensors, and temperature sensors. Sensors 152*a*–152*n* placed at suitable locations along the coiled tubing 111 are used to determine the operating conditions of downhole devices, monitor conditions or health of downhole devices, monitor production parameters, determine formation parameters and obtain information to determine the condition of the reservoir, perform reservoir modeling, to update seismic graphs and monitor remedial or workover operations. Such sensors may include pressure sensors, temperature sensors, vibration sensors and accelerometers. At least some of these sensors may monitor formation parameters or parameters present outside the borehole 102 such as the resistivity of the formation, porosity, bed boundaries etc. Sensors for determining the water content and other constituents of the formation fluid may also be used. Such sensors are known in the art and are thus not described in detail. Also, the present invention is particularly suitable for the use of fiber optic sensors distributed along the string 110. Fiber optic sensors are small in size and can be configured to provide measurements that include pressure, temperature, vibration and flow.

A processor or controller 140 at the surface 105 communicates with the downhole devices such as 124 and 130 and sensors 150*a*–150*m* and 152*a*–152*n* via a two-way communication link 160. As an alternative or in addition to the processor 140, a processor 140*a* may be deployed downhole to process signals from the various sensors and to control the devices in the string 110. The communication link 160 may be installed along the inside or outside of the coiled tubing 111. The communication link 160 may contain one or more conductors and/or fiber optic links. Alternatively, a wireless communication link, such as electromagnetic telemetry, or acoustic telemetry may be utilized with the appropriate transmitters and located in the string 110 and at the surface 105. A hydraulic line 162 is preferably run along the tubing 111 for supplying fluid under pressure from a surface source to hydraulically operated devices. The communication link 160 and the hydraulic line 162 are accessible at the coiled tubing remote end 111*b* at the surface, which allows testing of the devices 124 and sensors 150*a*–150*m* and 152*a*–152*n* at the surface prior to transporting the string 110 to the well site 105 and then operating such devices after the deployment of the string 110 in wellbore 102. After the string 110 has been installed in the wellbore 102, the hydraulically-operated downhole devices are activated by supplying fluid under pressure from a source at the surface (not shown) via the hydraulic line 162. Electrically-operated devices are controlled vial the link 160.

The information or signals from the various sensors 150*a*–150*m* and 152*a*–152*n* are received by the controller 140 and/or 140*a*. The controller 140 and/or 140*a* which include programs or models and associated memory and data storage devices (not shown), manipulates or processes data from the sensors 150*a*–150*m* and 150*a*–150*n* and provides control signals to the downhole devices such as the flow control device 124, thereby controlling the operation of such devices. The controls may be accomplished via conventional methods or fiber optics. The controllers 140 and/or 140*a* also process downhole data during the life of the wellbore. As noted above, data from the pressure sensors, temperature sensors and vibration sensors may also be utilized for secondary recovery operations, such as fracturing, steam injection, wellbore cleaning, reservoir monitoring, etc. Accelerometers or vibration sensors may be used to perform seismic surveys which are then used to update existing seismic maps.

It should be obvious that FIG. 1 is only an example of the coiled tubing string with exemplary devices. Any spoolable device may be used in the string 110. Such devices may also include safety valves, gas lift devices landing nipples, packer, anchors, pump out plugs, sleeves, electrical submersible pumps (ESP's), robotics devices, etc. The specific devices and sensors utilized will depend upon the particular application. It should also be noted that the spooled coiled tubing string 110 may be designed for both open holes and cased holes.

Figure 2:
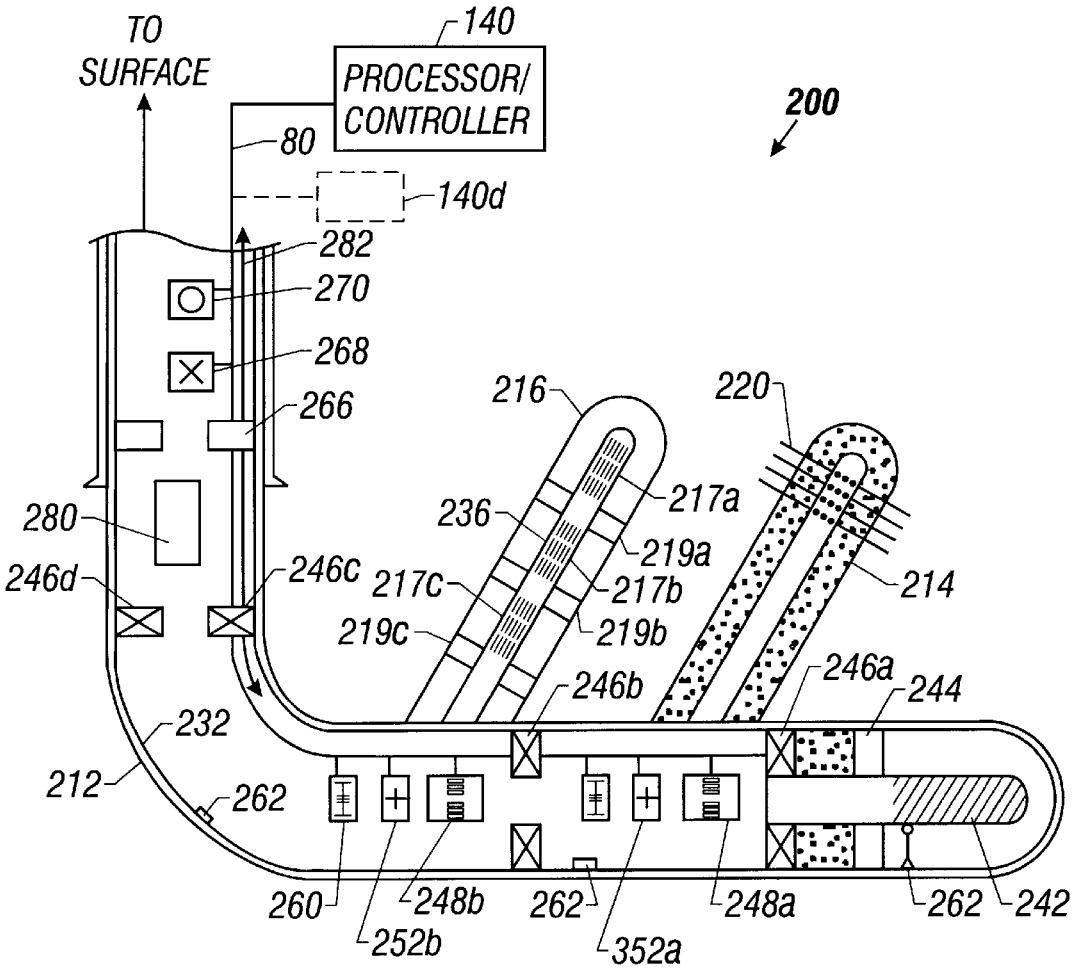
FIG. 2 is a schematic illustration of a spoolable coiled tubing production string placed in a wellbore.

FIG. 2 shows an example of spooled production coiled tubing strings installed in a multilateral wellbore system 200. The system 200 includes a main wellbore 212 and lateral wellbores 214 and 216. The lateral wellbore 214 has a perforated zone 220 that allows the formation fluid to flow into the lateral wellbore 214 and into the main wellbore 212. The lateral wellbore 216 has installed a coiled tubing string 236 that contains slotted liners 217*a*–217*c* and externally casing packers (ECP's) 219*a*–219*c*. The packers 219*a*–219*c* are 21 activated from the surface after the string 236 has been placed in the wellbore 22 216 in the manner described above with reference to FIG. 1. The formation fluid enters the lateral wellbore 216 via the liners 217*a*–217*c* and flows into the main wellbore 212.

The spoolable coiled tubing production string 232 installed in the main wellbore includes an inflow control device 242, which may be wire-wrapped device, a slotted liner, a downhole or remotely-operated sliding sleeve, an instrumented screen or any other suitable device. A packer 244 (ESP or ECP) isolates the production zone from the remaining string 232. Isolation packers 246*a*–246*d* are placed spaced apart at suitable locations on coiled tubing string 232. The packers 246*a*–246*c* may be hydraulically-operated, either by the supply of the pressurized fluid from the surface, as described above or by the hydrostatic pressure that is activated in any manner known in the art. Flow control device 248*a* controls the fluid flow from the inflow control device 242 into the main wellbore while the device 248*b* controls the flow to the surface. Additional flow control devices may be installed in the string 232 or in the lateral wellbores. Flow meters 252*a* and 252*b* provide the flow rate at their respective locations in the tubing 232. Pressure and temperature sensors 260 are preferably distributively located in the tubing 232. Additional sensors, commonly referred herein by numeral 262 are installed to provide information about parameters outside the wellbore 212. Such parameters may include resistivity of the formation, contents and composition of the formation fluids, etc. Other devices, such as annular safety valves 266, swab valves 268 and tubing mounted safety valves 270 are installed in the tubing 236. Other devices, generally denoted herein by numeral 280 may be installed at suitable locations in the string. Such devices may include an electrical submersible pump (ESP) for lifting fluids to the surface 105 and other devices deemed useful for the efficient operation of the well and/or for the management of the reservoir.

A conduit 280 is used to provide hydraulic fluid to the downhole devices and to run conductors along the tubing 232. Separate conduits or arrangements may be utilized for the supply of the pressurized fluid from the surface and to run communication and power links. A processor/controller 140 at the surface preferably controls the operation of the downhole devices and utilized the information from the various sensors described above. One or more control units or processors 140*a* may be placed at a suitable locations in the coiled tubing string 232 to perform some or all of the functions of the processor/controller 140.

Figure 3:
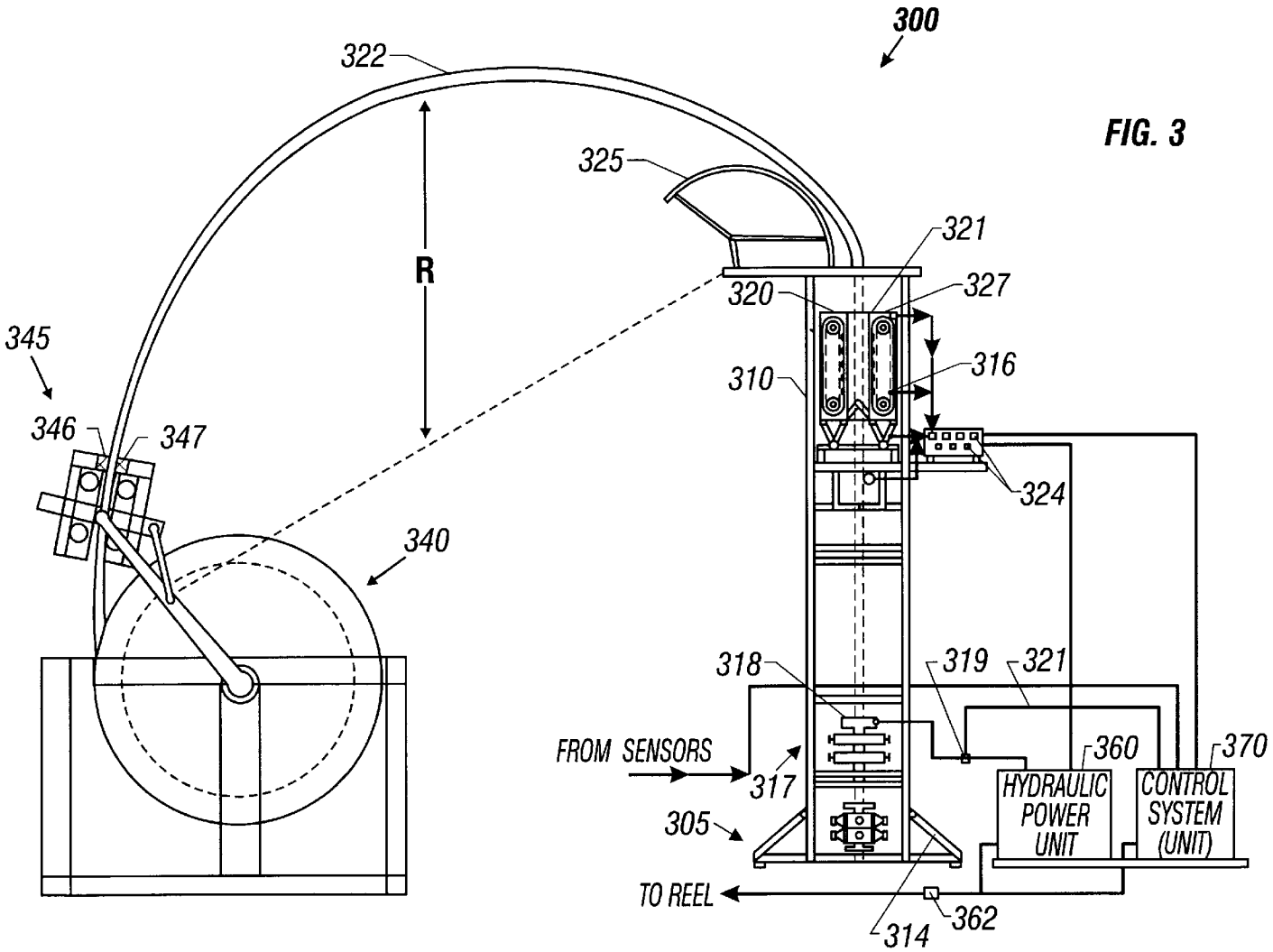
FIG. 3 is a schematic diagram of the spooled coiled tubing string being deployed into a wellbore with two variable width injector heads according to one embodiment of the present invention.

FIG. 3 is a schematic diagram showing the deployment of a spooled coiled tubing string 322 made according to the present invention into a wellbore utilizing adjustable opening injector heads. The coiled tubing string 322 containing the desired devices and sensors is preferably spooled on a large diameter reel 340 and transported to the rig site or well site 305. The string 322 is moved from the reel 340 to the rig 310 by a first injector 345 which is preferably installed near or on the reel 340. A second injector head 320 is placed on the rig 310 above the wellhead equipment generally denoted herein by numeral 317. The tubing 322 passes over a gooseneck 325 and into the wellbore via an opening 321 of the injector head 320. The reel injector 345 can maintain an arch of radius R of the tubing 322 that is sufficient to eliminate the use of the tubing guidance member or gooseneck 325 during normal operations, which reduces the stress on the tubing 322. The opening 346 of the reel injector 345 and the opening 321 of the main injector 320 can be adjusted while these injector heads moving the tubing 322 to accommodate for any upsets in the tubing string 322 and to adjust the gripping force applied on the tubing. Thus, with this system it is relatively easy move the tubing in and out of the wellbore to accommodate for any upsets in the tubing 322. The injector heads 320 and 345 are preferably hydraulically-operated. A control unit 370 controls electrically-operated valves 324 to control of the pressurized fluid from the hydraulic power unit 360 to the injector heads 320 and 345. Sensors 316, 319, 327, 347, and 362 and other desired sensors appropriately installed in the 1 8 system of FIG. 3 provide information to the control unit 370 to independently control the width of the openings 321 and 346, the speed of the tubing 322 through each of the injectors 320 and 345 and the force applied by such injectors onto the tubing 322. This allows for independent adjustment of the head openings to accommodate for any upsets in the tubing 322 and the movement of the tubing into or out of the wellbore 102 from a remote location without any manual operations at the rig. The two injector heads ensure adequate gripping force on the tubing 322 at all times and make it unnecessary to assemble coiled tubing strings without any upsets.

The devices utilized in the coiled tubing strings are flexible enough so that they can be spooled on reels. The strings made according to the present invention are preferably fully assembled at the factory and tested from the remote end (uphole end) of the tubing via the hydraulic lines and communication links in the tubing. The specific devices, sensors and their locations in the string depend upon the particular application. The assembled string may have upsets at its outer surface. The string is transported to the well site and conveyed into the wellbore via an injector head system with remotely adjustable head opening. In addition to the use of various sensors and devices in the spoolable strings of the present invention, it also allows integrating the devices with conventional designs without requiring them being flush with the outer diameter of the tubing.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. An oilfield production string assembled at the surface to include sensors and a controlled device, and available for testing of the sensors and device on the string from the remote end of the string before deployment downhole comprising:

coil tubing carried on a reel at the surface of sufficient length to reach the desired depth downhole;

a flow control device on the coiled tubing regulating flow of produced fluids from the well;

a controller associated with the flow control device controlling the operation of the device and the flow of fluid therethrough;

a first set of sensors monitoring downhole production parameters adjacent the flow control device; and a second set of sensors at spaced locations along the coiled tubing spaced from the flow control device, with information from one or more sensors being received at the controller and with the controller providing a control signal to the control device.

2. The production string of claim 1 wherein the controller is located at least in part downhole.

3. The production of string of claim 1 wherein at least some of the second set of sensors monitor downhole production parameters.

4. The production string of claim 1 wherein at least some of the second set of sensors monitor parameters present outside of the wall of the bore hole.

5. The production string of claim 1 wherein at lease some of the sensors are on fiber optic.

6. The production string of claim 1 further comprising an optical fiber extending along the coiled tubing and serving as a communication link.

7. An oilfield production string assembled at the surface to include sensors and a controlled device, and available for testing of the sensors and device on the string from the remote end of the string before deployment of the string downhole comprising;

coiled tubing carried on a reel at the surface and of sufficient length to reach the desired depth downhole;

a flow control device on the coiled tubing regulating flow of produced fluids from the well;

a controller associated with the flow control device controlling the operation of the device and the flow of fluid there through;

a first set of sensors monitoring downhole production parameters adjacent the flow control device; and completion equipment on the tubing projecting radially outwardly from the outer diameter of the coiled tubing.

8. The production string of claim 7 wherein the completion equipment comprises a packer.

9. The production string of claim 7 wherein the completion equipment comprises a safety valve.

10. The production string of claim 7 wherein the completion equipment comprises artificial lift equipment.

11. The production string of claim 7 further comprising a second set of sensors at spaced location along the coiled tubing spaced from the flow control device.

12. The production string of claim 7 wherein the controller is located at least in part downhole.

13. A spooled coiled tubing string assembled at the surface to include sensors and a controlled device and available for testing of the sensors and device before deployment of the spooled coiled tubing string in a wellbore, comprising:

a coiled tubing of sufficient length to reach the desired depth in the wellbore;

a flow control device on the coiled tubing adapted to be controlled from a remote end of the coiled tubing;

a plurality of sensors, at least one said sensor providing information relating downhole fluid flow; and a controller associated with the device, said controller receiving information from the sensor after deployment of the tubing in the wellbore and in response thereto providing a control signal to control the device.

14. The coiled tubing string of claim 13 wherein the flow control device is selected from a group consisting of; (a) a fluid flow control valve, (b) an instrumented screen, an adjustable slotted sleeve, and (d) an electrical submersible pump.

15. The coiled tubing string of claim 13 further comprising a second device on the coiled tubing that causes an upset in the outer dimension of the coiled tubing.

16. The coiled tubing string of claim 15 wherein the second device is selected from a group consisting of (a) a packer, (b) an anchor, an annulus valve and (d) an electrical submersible pump.

17. A method of deploying a spoolable coiled tubing string in a wellbore, comprising;

providing a coiled tubing of sufficient length to reach the desired depth in the wellbore;

integrating at least one spoolable device in the coiled tubing that causes an upset in the outer dimensions of the coiled tubing, said device adapted to be controlled from a remote end of the coiled tubing, the coiled tubing with the spoolable device making the spoolable coiled tubing string;

spooling the coiled tubing string on a reel and transporting said reel to a wellsite;

deploying the coiled tubing in the wellbore by an injector head having an adjustable opening that allows the passage of upset therethrough;

operating the device from the remote end of the coiled tubing.

18. The method of claim 17 further comprising:

providing a plurality of sensors in the string, at least one such sensor providing measurements for a downhole parameter; and providing a processor, said processor receiving information from the sensor and in response thereto providing a signals for controlling the operation of the device.

* * * * *